US011684113B2

(12) United States Patent
Badger et al.

(10) Patent No.: US 11,684,113 B2
(45) Date of Patent: Jun. 27, 2023

(54) FOOTWEAR WARMING SYSTEM AND DEVICE

(71) Applicant: Mountain Venture Holdings, LLC, Holladay, UT (US)

(72) Inventors: Austin Badger, Salt Lake City, UT (US); Robert Jesse Taylor Badger, Salt Lake City, UT (US); John Badger, Salt Lake City, UT (US); Robert David Badger, Salt Lake City, UT (US)

(73) Assignee: MOUNTAIN VENTURE HOLDINGS, LLC, Holladay, UT (US)

( * ) Notice: Subject to any disclaimer, the term of this patent is extended or adjusted under 35 U.S.C. 154(b) by 137 days.

(21) Appl. No.: 16/846,758

(22) Filed: Apr. 13, 2020

(65) Prior Publication Data

US 2020/0323303 A1 Oct. 15, 2020

Related U.S. Application Data

(60) Provisional application No. 62/833,137, filed on Apr. 12, 2019.

(51) Int. Cl.

| | |
|---|---|
| ***A43B 7/02*** | (2022.01) |
| ***A43B 5/04*** | (2006.01) |
| ***A43B 7/34*** | (2006.01) |

(52) U.S. Cl.

CPC ..... *A43B 7/02* (2013.01); *A43B 5/0427* (2013.01); *A43B 7/34* (2013.01); *A43B 5/0405* (2013.01)

(58) Field of Classification Search

CPC ..... A43B 7/02; A43B 7/34; A43B 5/0427; A43B 5/0405; A43B 5/0409; A43B 5/1616; A47L 23/20; A47L 23/205; A61F 2007/0045

See application file for complete search history.

(56) References Cited

U.S. PATENT DOCUMENTS

| | | | | | |
|---|---|---|---|---|---|
| 90,197 | A | * | 5/1869 | Rodgers | A43B 7/02 36/2.6 |
| 1,199,914 | A | * | 10/1916 | Mossor | A43B 7/02 36/2.6 |
| 1,257,086 | A | * | 2/1918 | Marcellus | A43B 7/02 36/2.6 |
| 1,270,666 | A | * | 6/1918 | Smith | A43D 3/1408 12/129.4 |

(Continued)

FOREIGN PATENT DOCUMENTS

| | | | |
|---|---|---|---|
| CN | 87205736 U | * | 11/1987 |
| CN | 2323736 Y | * | 6/1999 |
| GB | 190022071 A | * | 2/1901 |

OTHER PUBLICATIONS

HomeTop. HomeTop Premium Classic Rubber Hot Water Bottle, Great for Pain Relief, Hot and Cold Therapy. Retrieved from internet: http://www.amazon.com/HomeTop-Premium-Classic-Rubber-Therapy/dp/B00K3NZUPY/ref=sr_1_2?crid=23OAGATHL46BH&keywords=HomeTop%2BPremium%2BClassic%2BRubber%2BHot%2BWater%2BBottle% (Year: 2014).*

*Primary Examiner* — Khoa D Huynh
*Assistant Examiner* — Aiying Zhao
(74) *Attorney, Agent, or Firm* — Travis Banta; Loyal IP Law, PLLC

(57) ABSTRACT

A footwear warming system and device includes a boot and a footwear warming device. The footwear warming device may include a cap and be generally shaped to fill a void inside the boot. Hot water, or other liquid, may be poured into the footwear warming device to warm a boot.

12 Claims, 4 Drawing Sheets

(56) References Cited

U.S. PATENT DOCUMENTS

| | | | | |
|---|---|---|---|---|
| 3,823,434 | A * | 7/1974 | Krell | A43D 3/1408<br>12/129.4 |
| 2004/0010212 | A1* | 1/2004 | Kuiper | A61F 5/0104<br>601/152 |
| 2005/0189344 | A1* | 9/2005 | Bachman | A43B 7/02<br>219/528 |

* cited by examiner

FOOTWEAR WARMING SYSTEM AND DEVICE

PRIORITY CLAIM

This application claims the benefit of and priority to U.S. Provisional Patent Application No. 62/833,137, filed on Apr. 12, 2019, the contents of which are hereby incorporated by reference in their entirety.

BACKGROUND

1. Technical Field

This disclosure relates footwear warming system and device. The footwear warming device may be inserted into footwear and warm the footwear. The footwear warming system includes a device that can be inserted into the footwear.

2. Description of the Related Art

Since the time when humans had to brave the cold weather, warm footwear has been key to comfort and survival. Footwear initially included fur and other types of insulation to help keep the wearer's feet warm because insulation helps keep feet warm in cold weather. However, when insulation is exposed to cold air (e.g., a foot is not inside the footwear) the footwear may be just as cold as footwear without insulation. Thus, footwear, particularly footwear used in cold weather activities, may be at an ambient cold temperature before being worn by a user, causing the user discomfort when installing footwear or during use of the footwear.

Another conventional issue occurs when footwear is secured to the foot and the material of the footwear is cold. Cold footwear is less flexible and, as a result, is both more difficult to secure to the foot and uncomfortable to the foot because the material is unyielding to the foot. At least an internal portion of footwear is less flexible when cold. This decreased pliability in cold footwear makes the footwear both less effective or comfortable but also requires a user's natural body heat to warm, causing the user to feel cold as heat moves from the user's foot into the footwear. When footwear is able to secure to the foot properly it may better allow for natural movement. Thus, warm and well fitting pliable footwear allows natural movement and may prevent injuries to a user.

One example of popular cold weather footwear is a boot. A boot protects a larger portion of the lower extremities and therefore is a popular type of footwear for cold weather. However, once the used boot is removed it often has ice and snow frozen to the outside of the boot. Without the foot inserted into the boot, the boot loses its main heat source. Ice and snow on the boot may melt in ambient conditions (e.g., indoors, or in other locations where people sleep overnight) causing the boot to get wet both internally and externally. This causes the boot to frequently be wet and cold when it is again needed. Few would argue that a boot is never more uncomfortable than when it is cold and wet in the morning.

Boots of various kinds are used in many winter activities such as skiing and snowboarding. In many of these winter activities it is imperative that the boots are properly fit to the foot and that the boots, or boot inserts, are in good pliable condition. Winter activity boots are also prone to be coated in ice and snow and prone to not be warm enough to fit tightly to the foot. Due to the physical activity associated with the wearing of winter activity boots, comfort is a paramount concern to ensure that a user's foot is not injured (e.g., blisters or other foot ailments) due to a cold non-pliable boot.

Several conventional solutions to warming boots have been proposed. One solution has been to place boots near a heat source, such as, a fire, heaters, or heater vents. These heating devices are often immobile rendering them less useful as boot warming solutions. These particular heating devices further create a danger of burning or scorching the footwear. Additionally, heating devices are intended to generate and radiate heat uniformly to various areas of a shelter and are not made specifically for heating boots. Further, since boots generally dry from top to bottom and from outside to inside, boots oftentimes fail to dry or warm an internal toe end of the boot.

Other footwear warming devices are known which blow warm air into a boot, shoe, or other footwear. An opening of the footwear may be inserted over the warming device. The warming device is electrically powered to cause a filament within the warming device to increase in temperature while a fan blows air heated by the filament out of the device and into the footwear. This aids in warming and drying footwear. Unfortunately, since footwear is an enclosed area, the relative heat level must be low so as to not catch the footwear on fire, which also results in a relatively long duration of time to fully dry and warm wet and cold footwear. Further, this particular footwear warming device is not generally portable (batteries are typically an insufficient power source for such footwear warming devices) which means that only areas with electrical AC power can be used to warm footwear. Footwear warming devices typically cannot be used in vehicles which are, for example, on the way to a ski resort.

It is therefore one object of this disclosure to provide a footwear warming system and device which warms the entire cavity of footwear (e.g., a shoe or a boot). It is a further object of this disclosure to provide a system that allows the footwear to be heated in manner to allow the footwear to be properly secured to the foot in cold weather applications.

SUMMARY

A footwear warming device includes a body. The body has a top segment, a heel portion, and a toe projection. The body may extend vertically from the heel portion and horizontally from the heel portion toward the toe projection. The device further includes a retainer disposed about a circumference of the top segment of the body. The device further includes a cap disposed on the top segment of the body.

Also disclosed is a footwear warming system. The system includes a ski boot and a footwear warming device. The footwear warming device includes a body. The body has a top segment, a heel portion, and a toe projection. The body may extend vertically from the heel portion and horizontally from the heel portion toward the toe projection. The device further includes a retainer disposed about a circumference of the top segment of the body. The device further includes a cap disposed on the top segment of the body.

BRIEF DESCRIPTION OF DRAWINGS

The accompanying drawings illustrate several embodiments of a footwear warming system and device. The illustrated embodiments are exemplary and do not limit the scope of the disclosure.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the system and device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein.

Figure 1:
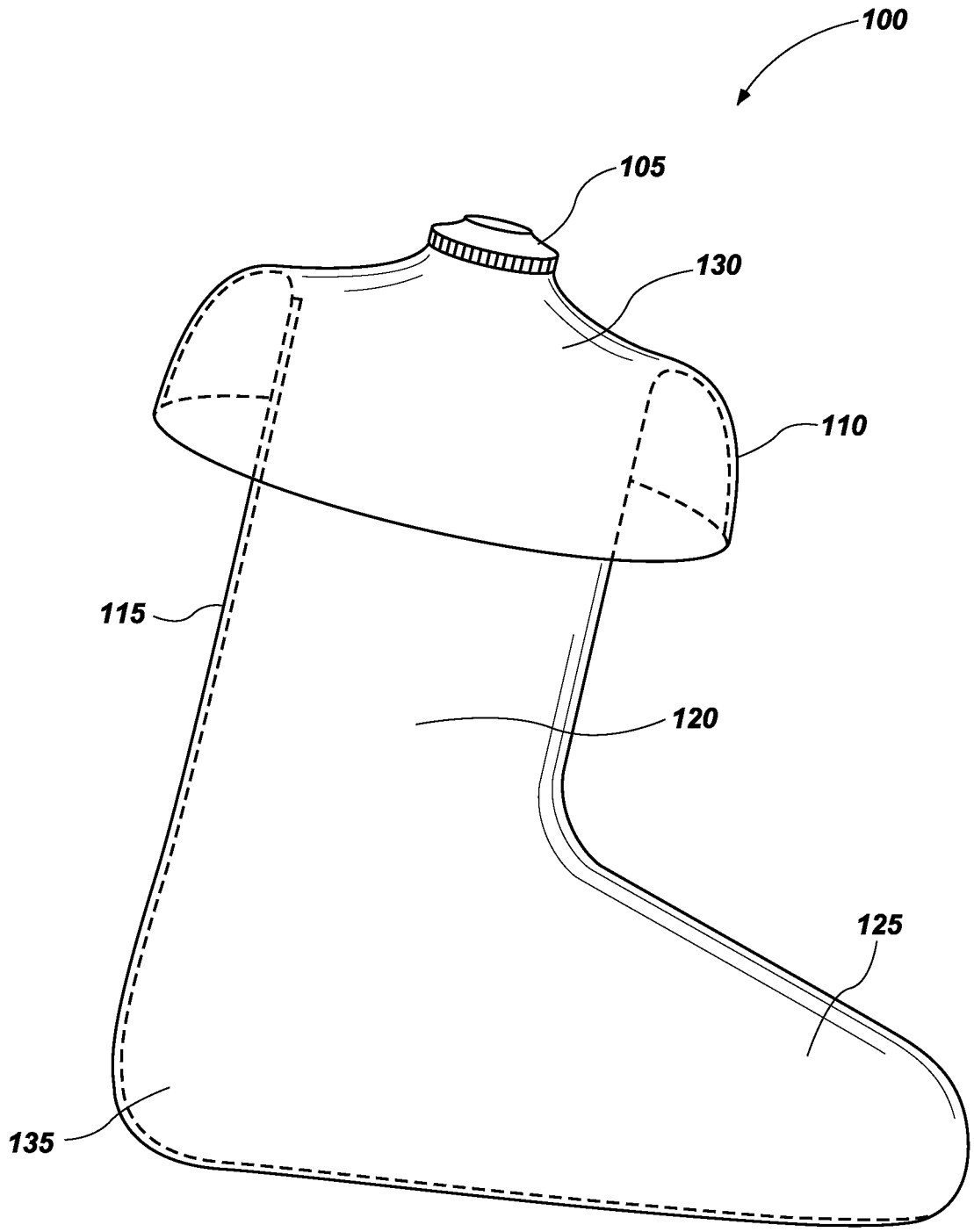
FIG. 1 illustrates a side view of an embodiment of a footwear warming device.

FIG. 1 illustrates a side view of an embodiment of a footwear warming device. Footwear warming device 100 may include cap 105 that attaches to top segment 130 of body 120 (also referred to as "body 120"). Cap 105 may be attached to the top segment 130 by a helical thread in a screw like manner. Cap 105 may also be secured to top segment 130 of body 120 by non-threaded friction. Cap 105 is generally made of a hard plastic material and opens to a hollow and watertight inside of body 120. Footwear warming device 100 is made of material, such as neoprene or other similar materials, that may hold hot liquid securely with cap 105 secured to the top segment 130 of body 120. Body 120 may be formed to a shape defined by a void within a footwear, such as a ski boot, so that the footwear warming device 100 contacts an entirety of an inside portion of the footwear. In other words, body 120 may be made of a form fitting material (e.g., neoprene) which fully fills a void in footwear. Body 120 may be generally angled and extend vertically from heel portion 135 with a toe projection that extends horizontally from heel portion 135 such that the angle between a bottom of heel 135 and spine 115 is up to 90° (e.g, perpendicular). However, an angle between a bottom of heel 135 and spine 115 is more preferably arranged in the range of 60° to 80° to allow body 120 to be more easily installed in and removed from footwear.

The top segment 130 of body 120 may be encircled by a retainer 110. Retainer 110 may fold down towards heel portion 135 of body 120. Retainer 110 may be folded downwards over a top of a boot to hold footwear warming device 100 in place, especially when body 120 is filled with hot water. In other words, retainer 110 provides a bearing structure that rests on an opening of a boot, for example, to support footwear warming device 100 when installed within a boot such that footwear warming device 100 does not slide into the boot or fail to stay upright in the boot. Retainer 110 may also fold upwards to extend beyond the top segment 130 of body 120 to make footwear warming device 100 easily removable. Body 120 may optionally include finger holes or attached cordage through which fingers may be inserted to easily grip retainer 110 for removal of body 120 from footwear. Footwear warming device 100 may include a spine 115 that starts near cap 105 and goes down to heel portion 135. Spine 115 may be implemented as a support that provides rigidity to body 120 such that spine 115 is more rigid than body 120. In this case, the term rigidity encompasses a spectrum where more rigid elements of footwear warming device 100 are more capable of supporting their own weight than less rigid elements of footwear warming device 100. Spine 115 may be more rigid than body 120 by forming spine 115 with metal, plastic, or other material, in a manner that makes spine 115 more able to maintain shape in an upright position. At heel portion 135 of body 120 spine 115 bends around heel portion 135 towards toe projection 125 and ends at toe projection 125. Spine 115 provides a rigid framework to facilitate insertion of footwear warming device 100 inside a boot, for example. Toe projection 125 fills a toe end of the footwear in which it is placed.

Figure 2:
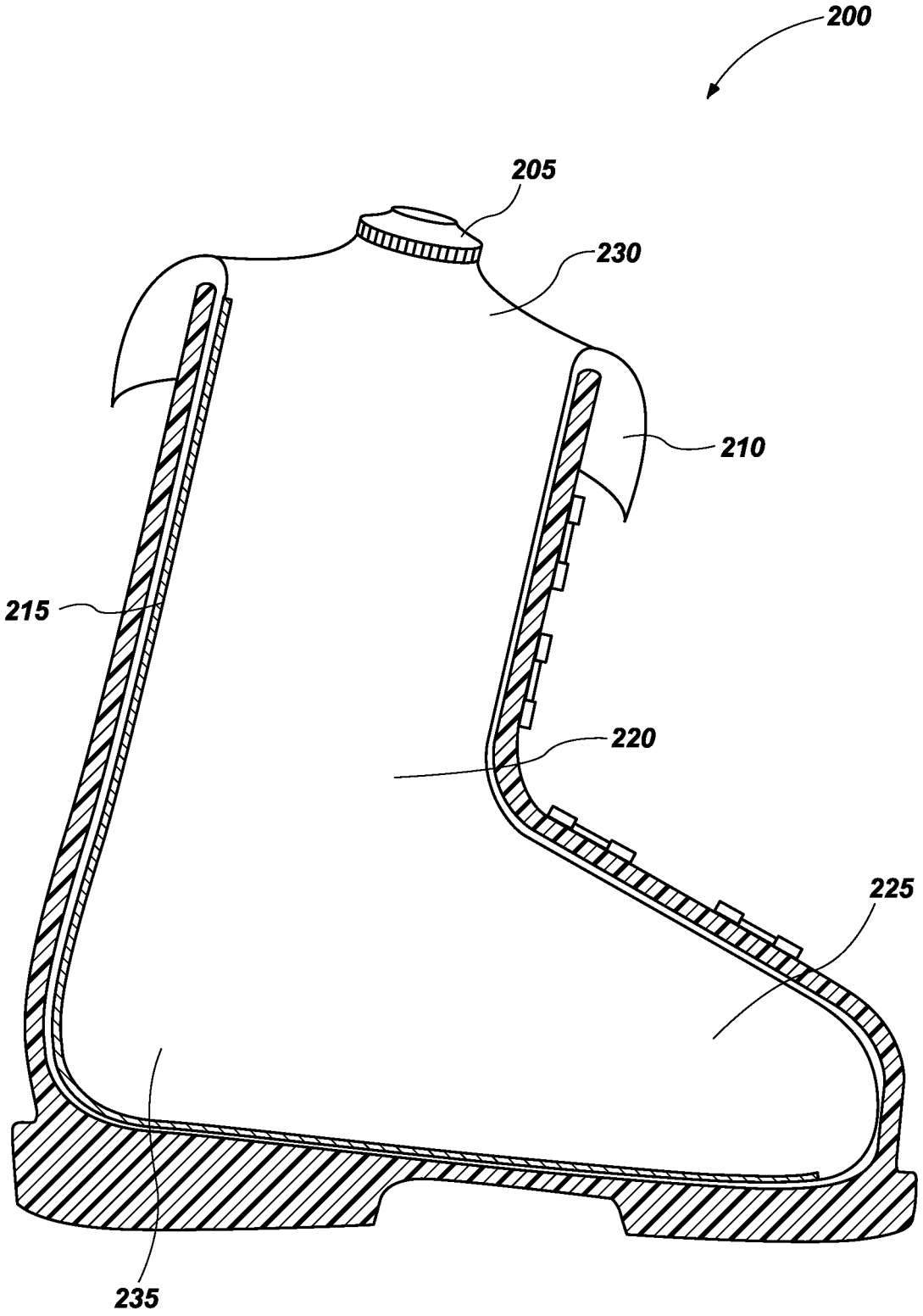
FIG. 2 illustrates a cross sectional view of an embodiment of a footwear warming system and device.

FIG. 2 illustrates a cross sectional view of an embodiment of a footwear warming system and device 200. Footwear warming device 200 may include cap 205 that attaches to top segment 230 of body 220. Cap 205 may be attached to the top segment 230 by a helical thread in a screw like manner. Cap 205 may also be secured to top segment 230 of body 220 by non-threaded friction. Cap 205 is generally made of a hard plastic material and opens to a hollow inside of body 220. Cap 205 may further incorporate a valve within body 220 which prevents a hot fluid from escaping (e.g., may be screwed into a screw in valve in the body). Footwear warming device 200 is made of material, such as neoprene or other similar materials, that may hold hot liquid securely with cap 205 secured to the top segment 230 of body 220. Body 220 may be formed to a shape defined by a void within a boot, such as a ski boot, so that the footwear warming device 200 contacts an entirety of an inside portion of the boot.

The top segment 230 of body 220 may be encircled by a retainer 210. Retainer 210 may fold down towards heel portion 235 of body 220. Retainer 210 may be folded downwards over a top of a boot to hold footwear warming device 200 in place. In other words, retainer 210 provides a bearing structure that rests on an opening of a boot, for example, to support footwear warming device 200 when installed within a boot such that footwear warming device 200 does not slide into the boot or fail to stay upright in the boot. Retainer 210 may also fold upwards to extend beyond the top segment 230 of body 220 to make footwear warming device 200 easily removable. Footwear warming device 200 may include a spine 215 that starts near cap 205 and extends down to heel portion 235. Spine 215 may be implemented as a support that provides rigidity to body 220 such that spine 215 is more rigid than body 220. In this case, the term rigidity encompasses a spectrum where more rigid elements of footwear warming device 200 are more capable of supporting their own weight than less rigid elements of footwear warming device 200. Spine 215 may be more rigid than body 220 by forming spine 215 with metal, plastic, or other material, in a manner that makes spine 215 more able to maintain shape in an upright position. At heel portion 235 of body 220, spine 215 bends around heel portion 235 towards toe projection 225 and ends at the toe portion. Spine 215 provides a rigid framework to facilitate insertion of footwear warming device 200 inside a boot, for example. Toe projection 225 fills a toe end of the footwear in which it is placed.

Figure 3:
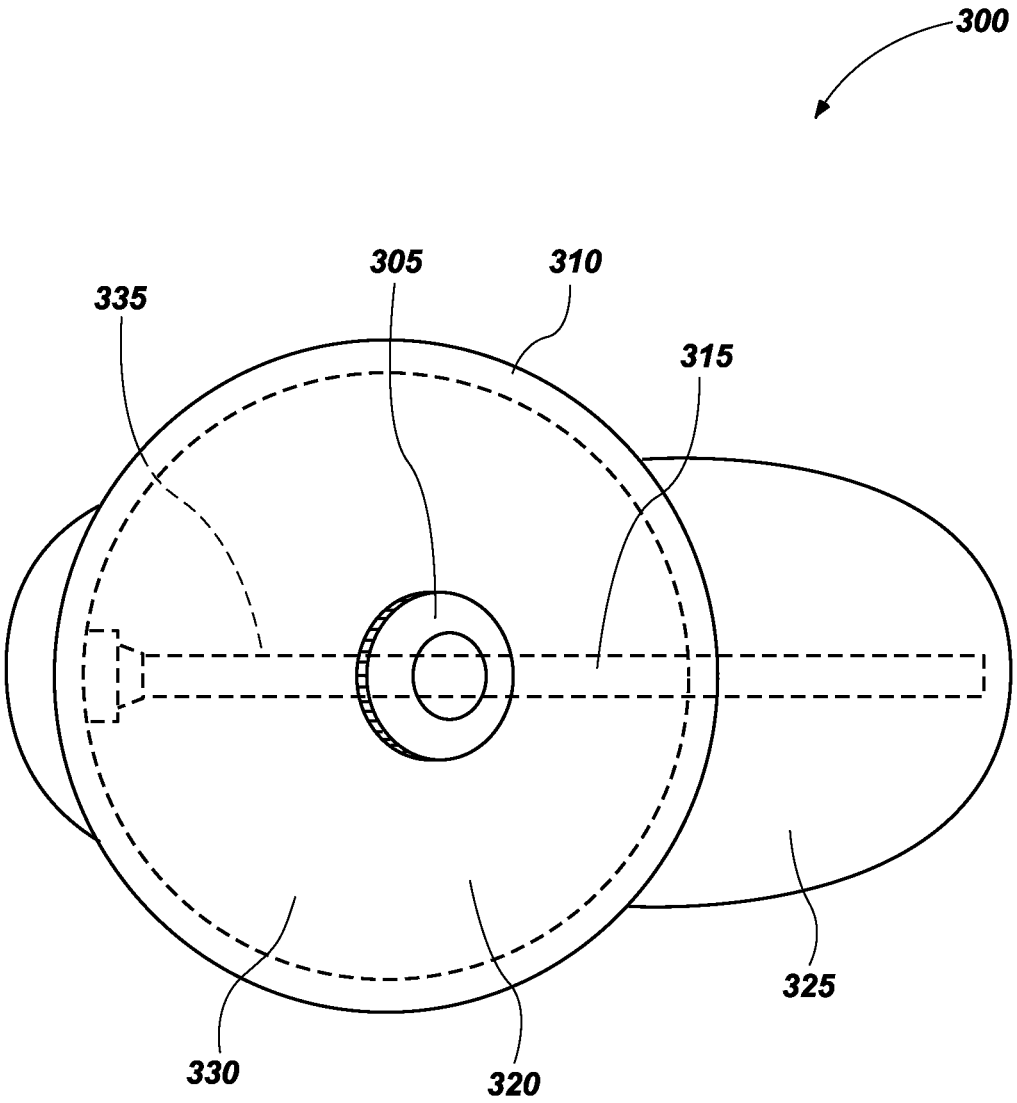
FIG. 3 illustrates a top view of an embodiment of a footwear warming device.

FIG. 3 illustrates a top view of an embodiment of a footwear warming device 300. Footwear warming device 300 may include cap 305 that attaches to top segment 330 of body 320. Cap 305 may be attached to the top segment 330 by a helical thread in a screw like manner. Cap 305 may also be secured to top segment 330 of body 320 by non-threaded friction. Cap 305 is generally made of a hard plastic material and opens to a hollow inside of body 320. Footwear warming device 300 is made as one or more pieces of watertight material, such as neoprene or other similar materials, that may hold hot liquid securely with cap 305 secured to the top segment 330 of body 320. Body 320 may be formed to a shape defined by a void within a boot, such as a ski boot, so that the footwear warming device 300 contacts an entirety of an inside portion of the boot.

The top segment 330 of body 320 may be encircled by a retainer 310. Retainer 310 may fold down towards heel portion 335 of body 320. Retainer 310 may be folded downwards over a top of a boot to hold footwear warming device 300 in place. In other words, retainer 310 provides a bearing structure that rests on an opening of a boot, for example, to support footwear warming device 300 when installed within a boot such that footwear warming device 300 does not slide into the boot or fail to stay upright in the boot. Retainer 310 may also fold upwards to extend beyond the top segment 330 of body 320 to make footwear warming device 300 easily removable.

Footwear warming device 300 may include a spine 315 that starts near cap 305 and goes down to heel portion 335. Spine 315 may be implemented as a support that provides rigidity to body 320 such that spine 315 is more rigid than body 320. In this case, the term rigidity encompasses a spectrum where more rigid elements of footwear warming device 300 are more capable of supporting their own weight than less rigid elements of footwear warming device 300. Spine 315 may be more rigid than body 320 by forming spine 315 with metal, plastic, or other material, in a manner that makes spine 315 more able to maintain shape in an upright position. At heel portion 335 of body 320 spine 315 bends around heel portion 335 towards toe projection 325 and ends at or before the toe portion. Spine 315 provides a rigid framework to facilitate insertion of footwear warming device 300 inside a boot, for example. Toe projection 325 fills a toe end of the footwear in which it is placed.

Figure 4:
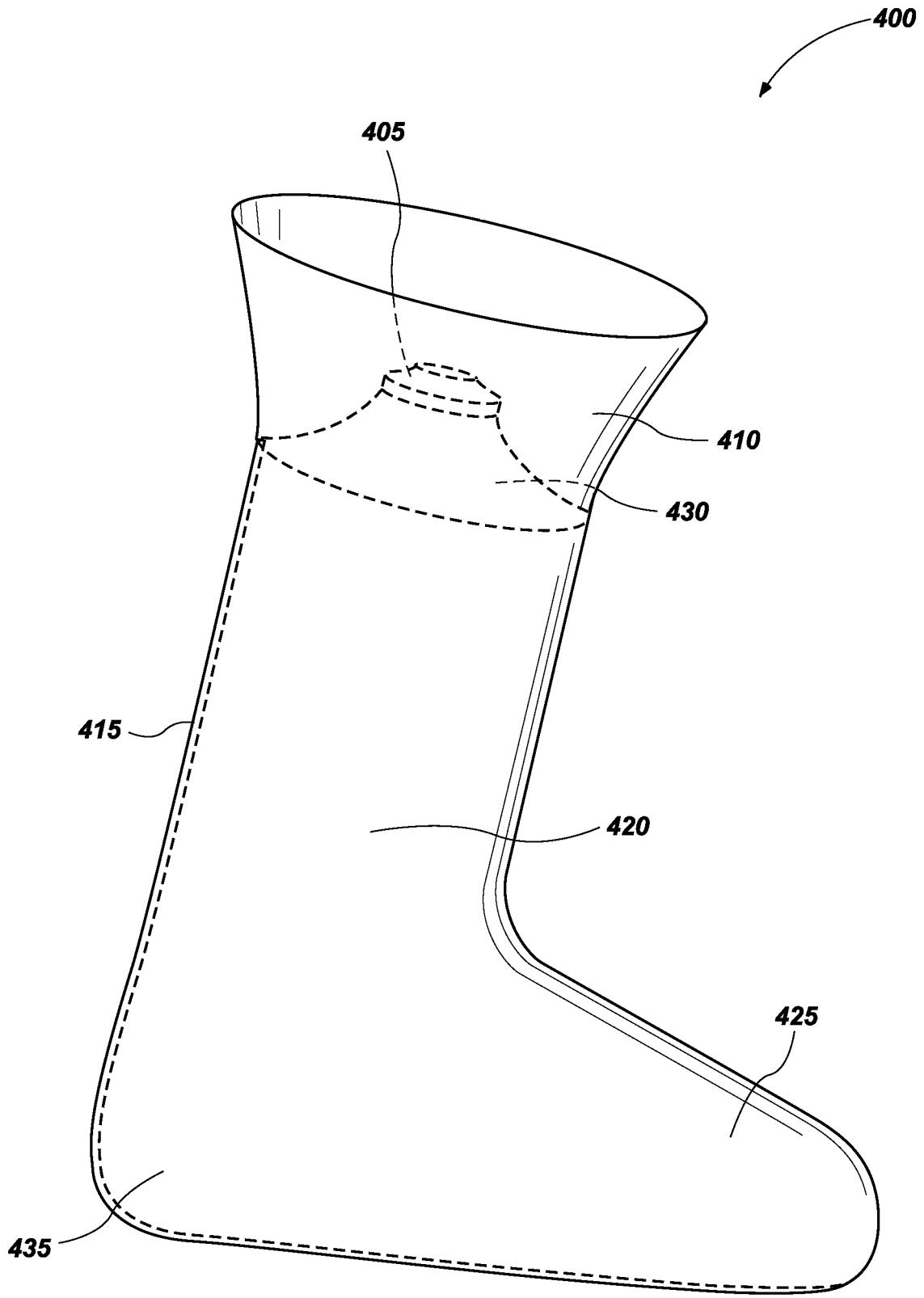
FIG. 4 illustrates a side view of an embodiment of a footwear warming device with inverted retainer.

FIG. 4 illustrates a side view of an embodiment of a footwear warming system and device with inverted retainer. Footwear warming device 400 may include cap 105 that attaches to top segment 430 of body 420. Cap 405 may be attached to the top segment 430 by a helical thread in a screw like manner. Cap 405 may also be secured to top segment 430 of body 420 by non-threaded friction. Cap 405 is generally made of a hard plastic material and opens to a hollow inside of body 420. Footwear warming device 400 is made of material, such as neoprene or other similar materials, that may hold hot liquid securely with cap 405 secured to the top segment 430 of body 420. Body 420 may be formed to a shape defined by a void within a boot, such as a ski boot, so that the footwear warming device 400 contacts an entirety of an inside portion of the boot.

The top segment 430 of body 420 may be encircled by a retainer 410. Retainer 410 may fold down towards heel portion 435 of body 420. Retainer 410 may be folded downwards over a top of a boot to hold footwear warming device 400 in place. In other words, retainer 410 provides a bearing structure that rests on an opening of a boot, for example, to support footwear warming device 400 when installed within a boot such that footwear warming device 400 does not slide into the boot or fail to stay upright in the boot. Retainer 410 may also fold upwards to extend beyond the top segment 430 of body 420 to make footwear warming device 400 easily removable.

Footwear warming device 400 may include a spine 415 that starts near cap 405 and extends down to heel portion 435. Spine 415 may be implemented as a support that provides rigidity to body 420 such that spine 415 is more rigid than body 420. In this case, the term rigidity encompasses a spectrum where more rigid elements of footwear warming device 400 are more capable of supporting their own weight than less rigid elements of footwear warming device 400. Spine 415 may be more rigid than body 420 by forming spine 415 with metal, plastic, or other material, in a manner that makes spine 415 more able to maintain shape in an upright position. At heel portion 435 of body 420 spine 415 bends around heel portion 435 towards toe projection 425 and may end at the toe portion. Spine 415 provides a rigid framework to facilitate insertion of footwear warming device 400 inside a boot, for example. Toe projection 425 fills a toe end of the footwear in which it is placed.

What is claimed is:

1. A device, comprising:

a body having a top segment, a heel portion, and a toe projection, the body extending from the heel portion toward the top segment and horizontally from the heel portion toward the toe projection;

a retainer disposed above a circumference of the top segment of the body, the retainer having a circumference that is greater than the circumference of the top segment of the body, the retainer being foldable in a first direction toward the heel portion over the top segment of the body and further foldable in a second direction which is opposite of the first direction;

a cap disposed on the top segment of the body; and a spine disposed in the body and implemented from a material that is more rigid than the body such that the spine maintains the top segment of the body in an upright position, the spine extending from the top segment of the body to the heel portion of the body and the spine extending from the heel portion and towards the toe projection.

2. The device of claim 1, wherein the spine further bends around the heel portion of the body.

3. The device of claim 1, wherein the body and the retainer are made from a form fitting material.

4. The device of claim 3, wherein the form fitting material is neoprene.

5. The device of claim 1, wherein the cap is one of a threaded cap and a friction fit cap.

6. A system, comprising:

a ski boot, and a footwear warming device, the footwear warming device comprising:

a body having a top segment, a heel portion, and a toe projection, the body extending from the heel portion toward the top segment and horizontally from the heel portion toward the toe projection;

a retainer disposed above a circumference of the top segment of the body, the retainer having a circumference that is greater than the circumference of the top segment of the body, the retainer being foldable in a first direction toward the heel portion over the top segment of the body and further foldable in a second direction which is opposite of the first direction;

a cap disposed on the top segment of the body; and a spine disposed in the body and implemented from a material that is more rigid than the body such that the spine maintains the top segment of the body in an upright position, the spine extending from the top segment of the body to the heel portion of the body and the spine extending from the heel portion and towards the toe projection.

7. The system of claim 6, wherein the spine further bends around the heel portion of the body.

8. The system of claim 6, wherein the body and the retainer are made from a form fitting material.

9. The system of claim 8, wherein the form fitting material is neoprene.

10. The system of claim 6, wherein the cap is one of a threaded cap and a friction fit cap.

11. The device of claim 1, wherein the retainer is a bearing structure that is configured to rest on an opening of a ski boot.

12. The device of claim 11, wherein the bearing structure supports the device when installed in the ski boot such that the device remains upright in the ski boot when the bearing structure rests on the opening of the ski boot.

* * * * *